US007748582B2

(12) United States Patent
Hayden

(10) Patent No.: US 7,748,582 B2
(45) Date of Patent: Jul. 6, 2010

(54) CONVERTIBLE BACKPACK AND SEAT WITH AN EXTENSIBLE BLANKET

(76) Inventor: Shirley A. Hayden, 5904 Mardella Blvd., Clinton, MD (US) 20735

( * ) Notice: Subject to any disclaimer, the term of this patent is extended or adjusted under 35 U.S.C. 154(b) by 1032 days.

(21) Appl. No.: 11/168,062

(22) Filed: Jun. 28, 2005

(65) Prior Publication Data

US 2006/0289572 A1 Dec. 28, 2006

(51) Int. Cl.
*A45F 4/02* (2006.01)
*A45C 15/00* (2006.01)

(52) U.S. Cl. ..... 224/153; 224/155; 224/157; 224/577; 224/581; 5/482; 5/502; 297/380

(58) Field of Classification Search ..... 224/581, 224/577, 153, 155, 156; 5/482, 502; 297/380
See application file for complete search history.

(56) References Cited

U.S. PATENT DOCUMENTS

| | | | | | |
|---|---|---|---|---|---|
| 2,146,400 | A | | 2/1939 | Maker et al. | 2/69 |
| 4,597,121 | A | * | 7/1986 | Bouma | 5/494 |
| 4,724,558 | A | * | 2/1988 | Reiff | 5/417 |
| 5,275,463 | A | | 1/1994 | Rocha | 297/229 |
| RE34,763 | E | * | 10/1994 | Tucker | 5/482 |
| 5,384,923 | A | * | 1/1995 | Hwang et al. | 5/419 |
| 5,414,881 | A | | 5/1995 | Terrazas | 5/417 |
| 5,884,331 | A | * | 3/1999 | Barajas | 2/69 |
| 5,975,626 | A | | 11/1999 | Aycock | 297/16.1 |
| 6,145,932 | A | * | 11/2000 | Hamel-Nyhus et al. | 297/465 |
| 6,231,119 | B1 | | 5/2001 | Zheng | 297/16.2 |
| 6,237,993 | B1 | | 5/2001 | Zheng | 297/16.2 |
| 6,241,311 | B1 | | 6/2001 | Zheng | 297/45 |
| 6,247,748 | B1 | | 6/2001 | Zheng | 297/16.2 |
| 6,494,530 | B1 | | 12/2002 | Zheng | 297/16.1 |
| 6,851,127 | B1 | | 2/2005 | Khan | 2/89 |

* cited by examiner

*Primary Examiner*—Nathan J Newhouse
*Assistant Examiner*—Adam Waggenspack
(74) *Attorney, Agent, or Firm*—Whiteford, Taylor & Preston LLP; Jeffrey C. Maynard

(57) ABSTRACT

A combination blanket and seat article is disclosed. The blanket portion comprises a king-size terry cloth sheet with two removable seat cushions installed in pockets. Straps attaché the seat back to the seat cushion and secure the seat for comfort. Weights around the periphery of the blanket secure it in place. The blanket portion can be used separately from the seat portion. When the seat is inserted, the back portion can be rolled to form a pillow. A strap is provided to hold the rolled back in position. Handles are provided for carrying the article. Shoulder straps are also provided to enable carrying the article as a backpack.

12 Claims, 4 Drawing Sheets

CONVERTIBLE BACKPACK AND SEAT WITH AN EXTENSIBLE BLANKET

BACKGROUND OF THE INVENTION

1. Field of the Invention

This invention generally relates to the field of convertible chairs and, in particular, to a foldable chair having a multipurpose blanket and that can be carried as a backpack and used as a pillow.

2. Background of the Prior Art

Many people who go to sporting events, parks, or concerts typically find that they have to bring a large number of items to ensure their comfort during the event. If it will be cold, a blanket will normally be brought. A blanket is also commonly employed as a ground covering if regular seats are not provided. At the beach, or for sunbathing, a blanket or large towel is customarily employed. Sometimes, a pillow is also desired.

For those who attend an event where seats are provided, the seats will often be made of hard plastic or metal. Seats of this type are usually quite uncomfortable and many users will therefore bring a soft cushion with them.

Accordingly, there remains a need for a simple combination seat and blanket that eliminates the need to carry multiple objects.

SUMMARY OF THE INVENTION

In its normal, folded condition, the invention is similar in size and shape to a backpack and includes shoulder straps and/or carry handles to allow it to be carried in a similar manner. A retaining strap is secured to the seat portion at a location where, when the article is in its folded form, the strap can be extended from one side of the article to the other and be releasably secured in that position to maintain the article in its folded condition.

If a user wishes to use the article as a blanket alone, he or she would completely unfold the article and drape it over his or her body. In this manner, the article is functionally identical to a stadium blanket with pockets.

When used as a wrap-around protective covering, the blanket is draped about the shoulders of the user, and when used as a lap blanket, the blanket is draped across the lap of the user. With the collapsible seat in place, the combination is particularly well suited for use by a spectator in an outdoor sports venue, such as an open-air stadium, in which the spectator is normally exposed to the outdoor weather.

It is, therefore, an object of the present invention to provide a combination blanket and seat that avoids the disadvantages of the prior art.

It is an object of the present invention to provide a blanket that can be selectively used as a wrap-around protective covering, a lap blanket or a ground cover.

Another object of the present invention is to provide such a blanket and seat combination that can be secured in a folded condition and that includes means enabling the combination to be easily carried between sites.

A further object of the present invention is to provide such a blanket and seat combination that, when placed in a spread condition and positioned over a user, adequately protects the user from cold or inclement weather.

Still another object of the present invention is to provide seat portion that is capable of being converted into a pillow.

Yet still another object of the present invention is to provide such a blanket and seat combination that is uncomplicated in construction yet effective in operation.

The various features of novelty that characterize the invention will be pointed out with particularity in the claims of this application.

BRIEF DESCRIPTION OF THE DRAWINGS

The above and other features, aspects, and advantages of the present invention are considered in more detail, in relation to the following description of embodiments thereof shown in the accompanying drawings, in which.

DETAILED DESCRIPTION OF THE INVENTION

The invention summarized above and defined by the enumerated claims may be better understood by referring to the following description, which should be read in conjunction with the accompanying drawings in which like reference numbers are used for like parts. This description of an embodiment, set out below to enable one to practice an implementation of the invention, is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figures 1, 1A:
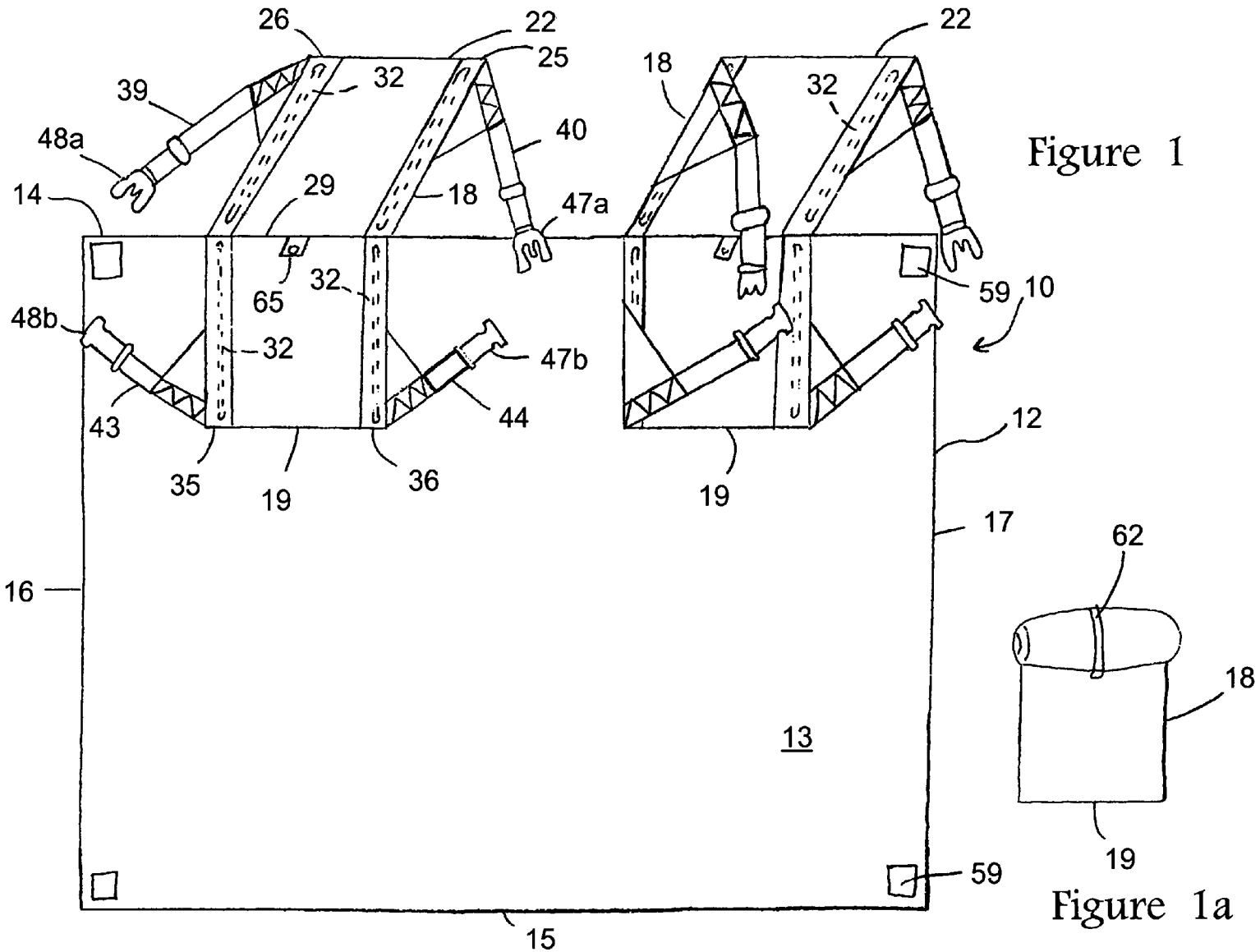
FIG. 1 shows a perspective view of a blanket and seat combination according to one embodiment of the present invention.
FIG. 1*a* shows a top view of a seat rolled into an alternate configuration according to one embodiment of the present invention.

Referring to the figures, FIG. 1 shows a blanket and seat combination, indicated generally as 10, according to the present invention. The blanket and seat combination 10 comprises a king size blanket 12. In one embodiment, the blanket 12 comprises a substantially rectangular, all-weather blanket having at least two-ply. The combination 10 further comprises at least one seat 18 having a bottom portion 19 and a top portion 22. In a preferred embodiment, the bottom portion 19 and top portion 22 comprise a removable, mildew resistant seat cushion.

The top portion 22 has a pair of sleeves 25, 26, each of which is open from the bottom 29 where the top portion 22 is hingedly attached to the bottom portion 19. A flexible rod 32 is removably stored in sleeves 25, 26. Similarly, the bottom portion 19 has a pair of sleeves 35, 36, each of which is open from the bottom 29 where the top portion 22 is hingedly attached to the bottom portion 19. A flexible rod 32 is removably stored in sleeves 35, 36. Such flexible rod 32 should be made of a material such as that used for flexible tent poles, so that the flexible rod 32 provides a certain amount of rigidity to the top and bottom portions 19, 22, yet can flex under strain. As described below, the flexible rod 32 can be removed from the sleeves 25, 26, 35, 36 to enable the seat to be rolled into an alternate configuration as shown in FIG. 1*a*.

A pair of straps 39, 40 is fixedly attached to the top portion 22 of seat 18 and a complementary pair of straps 43, 44 is fixedly attached to the bottom portion 19 of seat 18. Complementary fastening devices 47*a* and 47*b* are attached to straps 40, 44, respectively. Complementary fastening devices 48*a* and 48*b* are attached to straps 39, 43, respectively. Such fastening devices may be any type that permits the top portion 22 to be releasably connected to the bottom portion 19, and are well known in the art.

Figure 2:
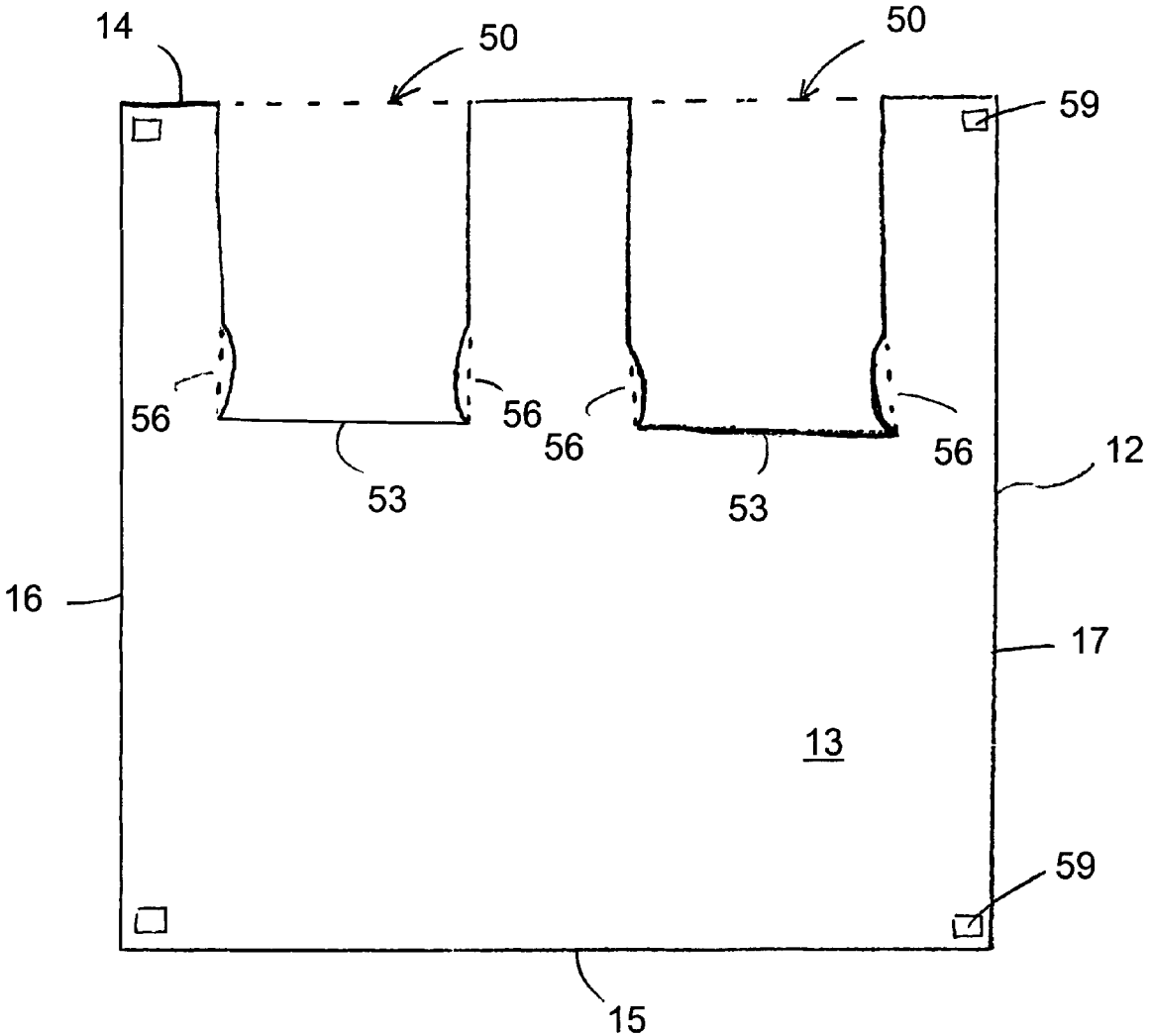
FIG. 2 shows a plan view of a blanket according to one embodiment of the present invention.

Referring to FIG. 2, at least one pocket 50 is formed along one edge of the blanket 12. In general, the blanket 12 includes a substantially flexible planar body 13 that is relatively rectangular in form and that has two opposite side faces bordered by a top edge 14, a bottom edge 15, and two opposing side edges 16, 17. The top and bottom edges 14, 15 may be somewhat shorter than the two remaining side edges 16, 17. In a preferred embodiment, the at least one pocket 50 is formed on one of the shorter edges, such as top edge 14. The pocket 50 is sized and configured to enable the bottom portion 19 of the at least one seat 18 to be placed in the pocket 50. At the bottom 53 of the pocket 50, there is an opening 56 on each side of the pocket 50. The opening 56 serves a dual purpose of enabling straps 43, 44 to pass therethrough and to allow a user sitting in the seat 18 to place their hands therein, for warmth. In some embodiments, the opening may include a separate lining for the user's hands. A plurality of soft weights 59 may be sewn into the planar body 13 at locations around the periphery of the blanket 12, preferably in the corners of the planar body 13, at least.

Blanket 12 can be used with or without the seat 18. Without seat 18, it functions as a standard blanket that can be draped about the user. In one embodiment as shown in FIG. 1*a*, with seat 18 in the pocket 50, the top portion 22 of the seat 18 can be converted for use as a pillow. The flexible rod 32 is removed from sleeve 25, 26 and the top portion 22 is rolled toward the bottom 29. A strap 62 is provided with a suitable fastener 65 at the bottom 29. Such fastener 65 may be, by way of non-limiting example, a hook and loop fastener to hold the top portion 22 in the rolled position. Other types of fasteners may be used. The flexible rod 32 may be rolled into the top portion 22 for storage.

Figure 3:
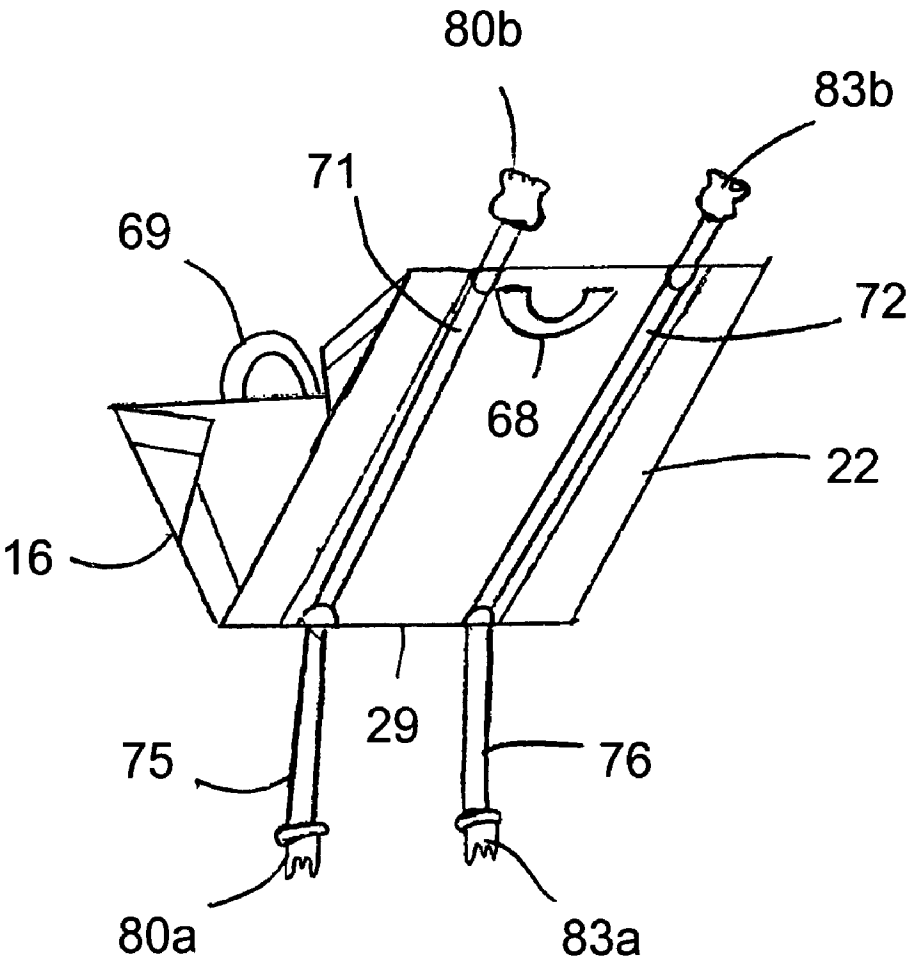
FIG. 3 shows a back perspective view of a seat according to one embodiment of the present invention.
Figure 4:
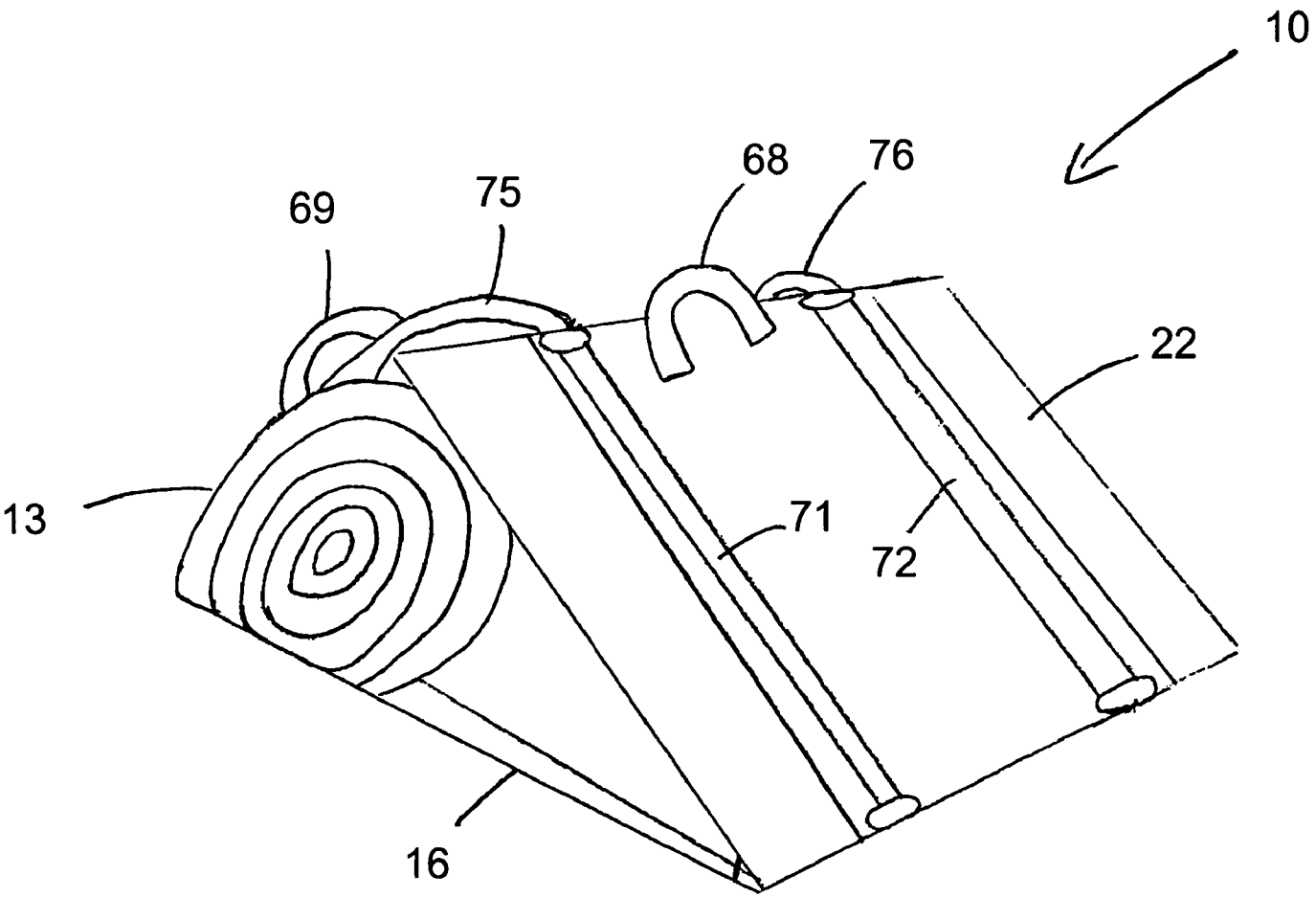
FIG. 4 shows a perspective view of a blanket and seat combination in a storage configuration according to one embodiment of the present invention.

FIG. 3 shows a back perspective view of the seat 18. Handles 68, 69 may be provided for carrying the blanket and seat combination 10. In another embodiment, a pair of shoulder straps 71, 72 is fixedly attached to a backside of the top portion 22 of seat 18 and a complementary pair of straps 75, 76 is attached at a single point to the outside of bottom 29. Complementary fastening devices 80*a* and 80*b* are attached to the free end of straps 71, 75, respectively. Complementary fastening devices 83*a* and 83*b* are attached to the free ends of straps 72, 76, respectively. Such fastening devices may be any type that permits the ends of the straps 71, 72, 75, 76 to be releasably connected to each other, and are well known in the art. The straps 71, 72, 75, 76 are sized and configured to enable such straps to wrap around the seat 18 to hold the seat 18 in a folded closed position as shown in FIG. 4. Alternatively, the straps 71, 72, 75, 76 can be attached to each other to form carrying handles such that the blanket and seat combination 10 can be carried like a backpack.

In use, the seat 18 can be inserted into pocket 50 and, with the flexible rods in sleeves 25, 26, 35, 36, a user can sit on the bottom portion 18 and wrap the blanket 12 about them. In some embodiments, a pair of seats 18 can be place side-by-side so that two users can share the blanket 12.

The invention has been described with references to a preferred embodiment. While specific values, relationships, materials and steps have been set forth for purposes of describing concepts of the invention, it will be appreciated by persons skilled in the art that numerous variations and/or modifications may be made to the invention as shown in the specific embodiments without departing from the spirit or scope of the basic concepts and operating principles of the invention as broadly described. It should be recognized that, in the light of the above teachings, those skilled in the art can modify those specifics without departing from the invention taught herein. Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is intended to include all such modifications, alternatives and other embodiments insofar as they come within the scope of the appended claims or equivalents thereof. It should be understood, therefore, that the invention may be practiced otherwise than as specifically set forth herein. Consequently, the present embodiments are to be considered in all respects as illustrative and not restrictive.

What is claimed is:

1. A combination blanket and chair, comprising:

a collapsible chair having a top portion and a bottom portion;

a flexible planar body of substantially rectangular form having a top edge, a bottom edge which is substantially parallel to the top edge and two opposite and parallel side edges which are substantially perpendicular to and extend between the top and bottom edges; and at least one pocket formed on the top edge of said planar body, wherein the bottom portion of said collapsible chair is disposed within said at least one pocket;

said at least one pocket comprising:

an open top end proximal the top edge of said planar body;

a closed bottom end;

a closed first side between the top end and bottom end, said first side having a first opening into the at least one pocket, adjacent to the bottom end; and a closed second side between the top end and bottom end, said second side having a second opening into the at least one pocket, adjacent to the bottom end;

said collapsible chair further comprising a pair of straps connecting the distal end of the top portion of said collapsible chair to the distal end of the bottom portion of said collapsible chair wherein each of the pair of straps passes through one of the first and second openings.

2. The combination blanket and chair according to claim 1, wherein said top portion of said collapsible chair is hingedly connected to the bottom portion of said collapsible chair.

3. The combination blanket and chair according to claim 1, wherein said planar body comprises a two-ply, all-weather blanket.

4. The combination blanket and chair according to claim 1, wherein said planar body comprises a blanket.

5. The combination blanket and chair according to claim 1, wherein said top edge and bottom edge are shorter than said side edges.

6. The combination blanket and chair according to claim 1, further comprising a plurality of soft weights around the periphery of said planar body.

7. The combination blanket and chair according to claim 6, wherein said soft weights are located at the corners of said planar body.

8. The combination blanket and chair according to claim 1, said top portion of said chair further comprising a sleeve having a removable rod therein.

9. The combination blanket and chair according to claim 1, said bottom portion of said chair further comprising a sleeve having a removable rod therein.

10. The combination blanket and chair according to claim 1, further comprising at least one handle.

11. The combination blanket and chair according to claim 1, further comprising a pair of shoulder straps for carrying said blanket and chair combination as a backpack.

12. The combination blanket and chair according to claim 1, wherein at least one of said top portion and said bottom portion of said chair comprises a cushion.

* * * * *